United States Patent [19]

Kohler et al.

[11] 4,007,345

[45] Feb. 8, 1977

[54] INDICATING ARRANGEMENT FOR INDICATING THE CONDITION OF THE SWITCHING CONTACTS OF A SWITCHING VESSEL IN A VACUUM-SWITCH APPARATUS

[75] Inventors: Werner Kohler, Bentfeld, Holstein; Norbert Steinemer, Berlin, both of Germany

[73] Assignee: Siemens Aktiengesellschaft, Munich, Germany

[22] Filed: Jan. 23, 1975

[21] Appl. No.: 543,544

[30] Foreign Application Priority Data

Jan. 31, 1974 Germany ..... 2405149

[52] U.S. Cl. ..... 200/144 R; 200/308; 116/124 L

[51] Int. Cl.[2] ..... H01H 33/02

[58] Field of Search ..... 200/308, 144 R; 116/124 L

[56] References Cited

UNITED STATES PATENTS 3,225,170 12/1965 Chabala ..... 200/308

3,619,533 11/1971 McFarland ..... 200/167 R 3,873,797 3/1975 Hannich ..... 200/308

FOREIGN PATENTS OR APPLICATIONS 1,815,722 9/1969 Germany

*Primary Examiner*—Gerald P. Tolin

*Attorney, Agent, or Firm*—Kenyon & Kenyon Reilly Carr & Chapin

[57] ABSTRACT

An indicating arrangement for indicating the condition of the switching contacts of a switching vessel is provided for a vacuum-switch apparatus having an actuator for opening and closing the switching contacts. The indicating arrangement includes a spring for pressing the switching contacts together when the actuator is actuated to close the contacts. The spring has a length corresponding to the closed position which is dependent upon the wear condition of the contacts. The changes of length of the spring are indicated as the switching contacts are worn from repeated switching operations.

4 Claims, 2 Drawing Figures

INDICATING ARRANGEMENT FOR INDICATING THE CONDITION OF THE SWITCHING CONTACTS OF A SWITCHING VESSEL IN A VACUUM-SWITCH APPARATUS

BACKGROUND OF THE INVENTION

The invention relates to vacuum-switch apparatus which includes at least one switching vessel and an actuator. The actuator is connected to the movable contact of the switching vessel by drive members and a contact pressure-spring is interposed between them.

Vacuum switchgear of this kind is described, for instance, in Deutsche Offenlegungsschrift 1,815,722. The purpose of the contact pressure-spring is to make available a further contact force in addition to the contact force between the contacts of the switching vessel caused by the ambient air pressure. This is important particularly if a larger contact force is required than can be obtained by the air pressure or if far-reaching independence of the contact force from the air pressure is to be accomplished.

In the operation of vacuum-switch apparatus, there is the problem that the state of the switching vessels and particularly, of the contacts, is not directly visible. But if reliable operation is to be assured at all times, the switching vessels must be replaced if the burn-off of the contacts has become excessive. Accordingly, it is an object of the invention to provide an indicating arrangement for a vacuum-switch apparatus of the kind described above which enables the burn-off of the contacts to be recognizable without difficulty.

SUMMARY OF THE INVENTION

To achieve the foregoing object, a new and advantageous configuration is provided for inserting the contact pressure-spring into the drive mechanism of the vacuum-switch apparatus.

The indicating arrangement according to the invention is operated by the change of length of the contact pressure-spring occurring during closing and opening. Because, with the working stroke of the actuator remaining the same, the length change of the contact pressure-spring depends on the travel distance of the contacts and the latter changes according to the burn-off reached, the indicating arrangement gives information as to the condition of the contacts.

Thus, the indicating arrangement according to the invention is suitable for indicating the condition of the switching contacts of a switching vessel in a vacuum-switch apparatus having an actuator equipped with actuating means movable between first and second positions to open and close the switching contacts respectively.

According to a feature of the invention, a spring coacts with the actuating means for pressing the switching contacts together when the actuating means is moved to the second position. The spring has a length at the second position dependent upon the wear condition of the contacts and indicating means for indicating the changes of length of the spring as the switching contacts are worn from repeated switching operations is provided.

The indicating arrangement according to the invention includes a coupling member which has two parts which are movable with respect to each other against the force of the contact pressure-spring and whose relative displacement can be read. This coupling member can be inserted between an actuator rod coupled to the actuator of the vacuum-switch apparatus and a lever acting on the movable contact of the switching vessel. The two parts of the coupling member can mutually engage with one part inside the other so as to be movably guided. The one part which extends through the bearing hole of the other part serves as the indicating part.

Thus, the above-mentioned actuating means can be viewed as including the actuator rod coupled to the actuator and the lever acting on the movable switching contact. The indicating arrangement then includes a coupling member arranged between the actuator rod and the lever, the coupling member including first and second parts movable relative to each other against the force of the spring and connectable to the actuator rod and the lever respectively. The indicating means is configured for indicating the relative displacement of these parts.

The reading of the indicating arrangement can further be facilitated by providing it with a marking to indicate excessive burn-off of the contacts.

According to another feature of the invention, these parts are arranged and configured so as to cause one of the parts to extend into and be movably guided in the other one of the parts. The indicating means then includes a bearing opening formed in the other part, the one part being movably guided in the bearing opening so as to extend therethrough a distance determined by the wear condition of the switching contacts.

With the spring tension of the contact pressure-spring remaining unchanged, the length of the coupling member may furthermore be changed so that the coupling member: first, makes available the contact force for a switching vessel; second, constitutes an indicating device for the burn-off of the contacts; and, third, makes it possible to adapt the actuator to the drive member and/or the switching vessel.

The indicating arrangement according to the invention is suited particularly for vacuum switchgear in the range of medium voltages wherein occasional monitoring of the burn-off of the contacts is desired.

Although the invention is illustrated and described herein as an indicating arrangement for indicating the condition of the switching contacts of a switching vessel in a vacuum-switch apparatus, it is nevertheless not intended to be limited to the details shown, since various modifications may be made therein within the scope and the range of the claims. The invention, however, together with additional objects and advantages will be best understood from the following description and in connection with the accompanying drawing.

DESCRIPTION OF THE PREFERRED EMBODIMENTS OF THE INVENTION

Figure 1:
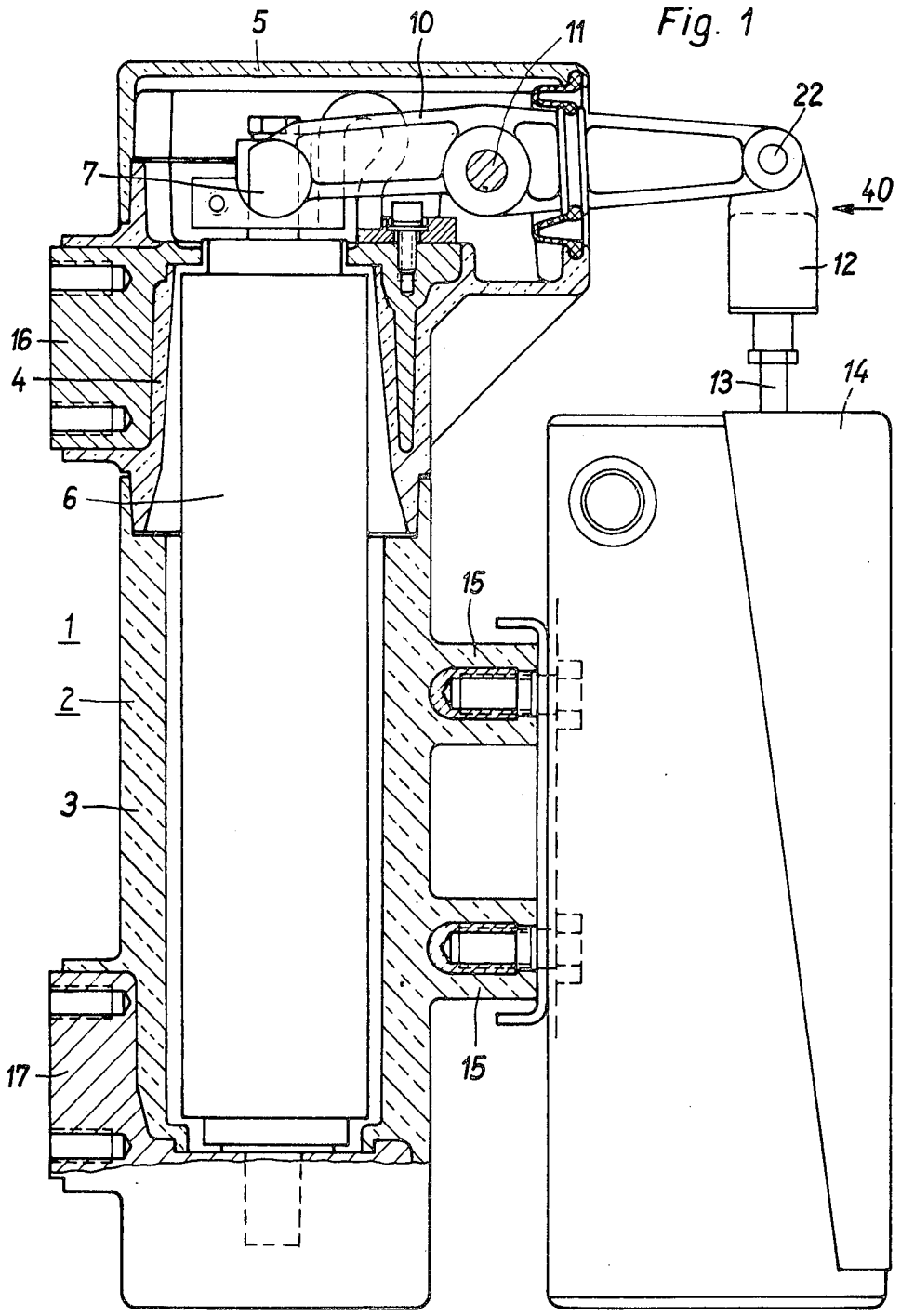
FIG. 1 is a schematic diagram, partially in section, of a vacuum-switch apparatus equipped with an indicating arrangement according to the invention.

The vacuum-switch apparatus in FIG. 1 has a housing 2 which is made of insulating material. The housing 2 includes a lower part 3, an upper part 4 and a cover 5. In the housing 2, a switching vessel 6 is arranged having a movable contact (not shown) which can be moved by a plunger 7 accessible at the upper end of the switching vessel 6. A two-armed insulating lever 10 articulately engages the plunger 7. The lever 10 and its bearing 11 are enclosed by the cover 5. To the free end of the lever 10 protruding from the covered space is hinged a coupling member 12, to which the actuating rod 13 of an actuator 14 (shown only in outline) is attached. The actuator 14 can operate, for instance, electromagnetically, with an electric motor, or hydraulically and may be equipped with an energy storage device that can be released by a switching command. The housing of the actuator 14 serves at the same time as the support of the insulating housing 2. For this purpose, the housing 2 is provided with support-like extensions 15 wherein there are threaded inserts for receiving fastening screws.

Figure 2:
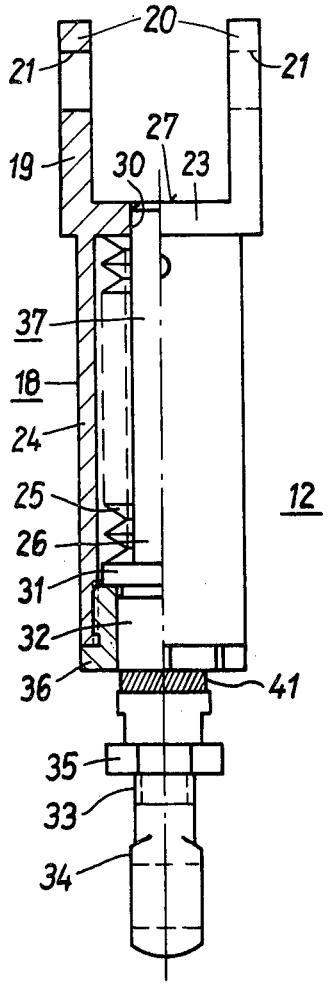
FIG. 2 is an enlarged view of the coupling member of the vacuum-switch apparatus of FIG. 1. The coupling member incorporates the indicating arrangement according to the invention.

The vacuum-switch apparatus shown in FIG. 1 which, according to its construction, can be used, for instance, in the range of medium voltages, has terminal conductors 16 and 17 which are embedded in the upper part 4 of the housing 2 and in the lower part 3, respectively. The configuration of the coupling member 12 will be explained in the following with reference being made to FIG. 2.

The coupling member 12 has an outer part 18 with a forked head 19 having legs 20 provided with in-line openings 21 for receiving a bearing pin 22 (FIG. 1) for connecting the part 18 with the free end of the lever 10. The end of the lever 10 is disposed here between the legs 20. Below a cross piece 23 connecting the legs 20, the part 18 has a hollow cylindrical extension 24 wherein a contact pressure-spring 25 is disposed. The spring 25 is configured as a stack of cup spring elements. In lieu of cup spring elements, other suitable spring elements or springs can also be used.

Through the central openings of the cup spring elements of spring 25, there extends a pin 26 having an upper end 27 guided in a hole 30 of the cross-piece 23. At its lower end the pin 26 has a shoulder 31 for the contact pressure-spring 25 and a shank 32 serving for guidance. The shank 32 is provided with internal thread. An eye screw 34 is screwed into the thread with its threaded stud 33 and secured against becoming loose by a lock nut 35. This arrangement makes it possible to adjust the length of the coupling member 12 whereby tolerances in the parts serving to transmit the force to the switching vessel 6 (FIG. 1) can be compensated. The shank 32 of the pin 26 is guided in a threaded sleeve 36 which is screwed into the extension 24 from below.

Together with the eye screw 34, the pin 26 forms an inner part 37 of the coupling member 12. The coupling member 12 is displaceable relative to the outer part 18 against the force of the spring 25. The displacement serves to indicate the burn-off as will be explained below.

When the vacuum-switch apparatus 1 is switched on, the pin 26 goes through the hole 30 of the cross-piece 23 by a certain amount if the contacts of the switching vessel 6 are in new condition. This overhang of the pin 26 can be read if the vacuum-switch apparatus 1 is viewed in the direction of the arrow 40 in FIG. 1. Since the overhang of the pin 26 above the cross-piece 23 becomes less with increasing burn-off of the contacts, the condition is finally reached when the end 27 of the pin 26 is flush with the upper edge of the cross-piece 23 or the bore 30. It is advantageous to make the correlation so that this flush position serves as an indication of excessive burn-off of the contacts and therefore for indicating the time when the switching vessel in question must be replaced.

In addition to this indicating device or also, in place of it, the shank 32 of the pin 26 may be provided with a recess 41 which may be filled-in in color such as red. The diminishing overhang of the pin 26 beyond the cross-piece 23 corresponds to an increasingly wider part of the recess 41 at the lower edge of the threaded bushing 36. Within the recess 41, divisions or other markings can be provided which allow the amount of burn-off to be read. In this way, a more accurate judgment of the burn-off can be achieved.

Accommodating the contact pressure-spring 25 in the coupling member 12 and the adjustability of the eye screw 25 thus create, in conjunction with the indicating device, a structural element for vacuum-switch apparatus which combines several functions and can easily be replaced. In addition, the coupling member is readily accessible because it is mounted between the free end of the lever 10 and the actuator rod 13.

What is claimed is:

1. In an arrangement which includes a vacuum-switch having a switching vessel with switching contacts at least one of which is movable and an actuator equipped with actuating means movable between first and second positions to open and close said switching contacts respectively, the actuating means including an actuator rod coupled to the actuator and a lever for acting on the movable switching contact, an indicating arrangement comprising: a spring coacting with said actuating means for pressing said switching contacts together when the actuating means is moved to the second position, said spring having a length at said second position dependent upon the wear condition of the contacts; a coupling member arranged between the actuator rod and the lever, said coupling member including first and second parts movable relative to each other against the force of said spring and connectable to said actuating rod and said lever respectively; and, indicating means for indicating the relative displacement of said parts, said displacement being dependent upon changes of length of said spring occurring as the switching contacts are worn from repeated switching operation.

2. The indicating arrangement of claim 1, said indicating means including mark means for an impermissible burn-off of the switching contacts.

3. The arrangement of claim 1, said parts being arranged and configured so as to cause one of said parts to extend into and be movably guided in the other one of said parts, said indicating means including a bearing opening formed in said other part, said one part being movably guided in said bearing opening so as to extend therethrough a distance determined by the wear condition of the switching contacts.

4. The arrangement of claim 1 comprising means for adjusting the length of said coupling member without changing the stress in said spring.

* * * * *